US006302639B1

(12) United States Patent
Endler et al.

(10) Patent No.: US 6,302,639 B1
(45) Date of Patent: Oct. 16, 2001

(54) FEED PUMP

(75) Inventors: Dirk Endler, Schenklengsfeld; Peter Marx, Kassel; Christoph Schmidt, Rotenberg, all of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/520,697

(22) Filed: Mar. 7, 2000

(30) Foreign Application Priority Data

Mar. 19, 1999 (DE) ..... 199 12 314

(51) Int. Cl.[7] ..... F04D 5/00
(52) U.S. Cl. ..... 415/55.1
(58) Field of Search ..... 415/55.1, 55.2, 415/55.3; 416/234, 237, DIG. 2

(56) References Cited

U.S. PATENT DOCUMENTS 5,762,469 * 6/1998 Yu ..... 415/55.1
5,807,068 9/1998 Dobler et al. ..... 415/55.1
6,132,185 * 10/2000 Wilhelm ..... 415/55.1 X

FOREIGN PATENT DOCUMENTS

0360681A1 3/1990 (EP) .

* cited by examiner

*Primary Examiner*—John E. Ryznic
(74) *Attorney, Agent, or Firm*—Mayer, Brown & Platt

(57) ABSTRACT

Feed pumps operating on the side channel or peripheral principle are known from use in fuel feed units of motor vehicles. These feed pumps often have rings of blade chambers, which are delimited by moving blades, said rings being located opposite one another in an impeller. Impellers, of which the moving blades of blade chambers located opposite one another are arranged in a V-shaped manner in relation to one another, already achieve high efficiencies. The new feed pump is to have improved efficiency, as compared with these. The moving blades of the feed pump are arranged at an angle to the axis of rotation of the impeller, this angle of the moving blades increasing from the radially inner to the radially outer region in proportion to the radial extent of the moving blade. The feed pump is suitable particularly for use in a fuel feed unit in a motor vehicle.

5 Claims, 2 Drawing Sheets

FEED PUMP

BACKGROUND OF THE INVENTION

1. Field of the Invention

The invention relates to a feed pump with a driven impeller rotating in a pump casing, with at least one ring of blade chambers which is arranged on one end face of the impeller, with a feed channel located opposite the ring of blade chambers and arranged in the wall of the pump casing and with moving blades laterally delimiting the blade chambers.

2. Background of the Invention

Feed pumps of this type are known as peripheral or side channel pumps and are often used in fuel feed units of motor vehicles. An electric motor arranged in the pump casing drives, via a shaft, the impeller which is located in the pump chamber. A feed channel located opposite the blade chambers is arranged in the wall of the pump chamber. As a result of the rotation of the impeller, fuel is sucked in through an intake orifice arranged in the pump chamber and is fed to an outlet orifice by means of the blade chambers and the feed channel. The liquid to be fed enters the blade chambers in the radially inner region of these due to centrifugal forces and emerges again in the radially outer region of the blade chambers. Since the blade chambers and the feed channel are at least approximately closed, a circulating flow is formed in the liquid.

In order to improve the efficiency of these feed pumps, numerous geometric designs are known for the inlet region into the pump chamber, for the feed channel and for the impeller. The configuration of the blade chambers and of the feed channel, in particular the cross section, is of great importance in the design of the impeller. In this case, impellers with mutually opposite rings of blade chambers have proved particularly suitable.

In order to improve the circulating flow between the feed channel and the blade chambers, it is known, furthermore, to arrange the moving blades of opposite blade chambers in a V-shaped manner in relation to one another, so that the moving blades are open forward in the direction of rotation. This arrangement of the moving blades allows energy to be transmitted to the flow more effectively. At the same time, turbulences occurring on the rear side of the moving blades are reduced. Impellers of this type therefore have improved efficiency, as compared with impellers, the moving blades of which are arranged perpendicularly to the end face.

Impellers of feed pumps are also known, the moving blades of which are twisted in the radially outer region very sharply in relation to the radially inner region. In addition to the complicated manufacture of impellers of this type, the flow behavior in the blade chambers may be adversely influenced on account of the pronounced angle difference between the inner and the outer blade regions.

SUMMARY OF THE INVENTION

The object on which the invention is based is to provide a feed pump having an improved flow behavior. At the same time, in particular, the impeller of the feed pump is to have a long service life and be capable of being produced cost-effectively.

The object is achieved, according to the invention, by means of the features of claim 1. Advantageous embodiments are described in the subclaims.

It was found that, for optimum energy transmission between the impeller and liquid, the design of the moving blades cannot be considered independently of the geometric dimensions of the impeller. On the contrary, in addition to the inflow angle and the outflow angle of the liquid into and out of the blade chambers, the flow in the blade chamber is also to be predetermined by the design of the moving blades by the radial dimensions of the feed channel and blade chamber being taken into account. Thus, an improvement in the efficiency of feed pumps with impellers, the moving blades of which are arranged at an angle to the axis of rotation of the impeller, is achieved in that the angle between the moving blade and axis of rotation increases from the radially inner to the radially outer region of the moving blade in proportion to the radial extent of said moving blade. The angle change of the moving blade is obtained according to the formula $$\alpha(r) = \arctan\left(\frac{r \cdot \tan(\alpha[r_a])}{r_a}\right).$$

Here, $\alpha(r)$ is the angle between the moving blade and the axis of rotation at a distance r from the center point of the impeller to any point on the moving blade. The angle $\alpha(r_a)$ is a predetermined angle between the moving blade and the axis of rotation at a distance $r_a$ from the center point of the impeller to a predetermined point on the moving blade.

It is essential to the invention that the flow conditions in the blade chambers are adapted to those in the feed channel by means of the moving blades, since these size ratios have a decisive influence on the circulating flow which is formed. This is ensured by the proportionality of the angle change in relation to the dimensions of the feed channel and of the blade chambers, mainly their radial extent.

The advantage of the feed pump is that the design of the moving blades leads to an additional acceleration of the liquid in the circumferential direction and the liquid emerges from the blade chambers at a changed angle, thereby achieving an improvement in efficiency. The proportionality of the angle change ensures, at the same time, that the formation of too high a velocity vector in the tangential direction is avoided in the radially inner region of the feed channel. This vector would result in excessive acceleration of the liquid in the circumferential direction on entry into the blade chambers, which, in turn, would lead to efficiency-reducing backflows in the blade chambers.

Another advantage is that the service life of the impeller is increased. The reason is to be seen, above all, in that the configuration of the moving blades is no longer carried out separately from the predetermined geometries and flow conditions. Furthermore, impellers of this type can be produced cost-effectively by means of injection molding.

The radially inner edge, the center or the radially outer edge of the moving blade (3) is predetermined as the predetermined point for the distance $r_a$. Impellers which are at an angle $\alpha(r_a)$ of between 30° and 40° to the axis of rotation at their radially outer edge are particularly advantageous.

In a further advantageous embodiment with blade chamber rings arranged on the two end faces of the impeller, moving blades located opposite one another are arranged in V-shaped manner in relation to one another.

BRIEF DESCRIPTION OF THE DRAWINGS

The invention is explained in more detail by means of an exemplary embodiment. At the same time.

DETAILED DESCRIPTION OF THE PREFERRED EMBODIMENT

Figure 1:
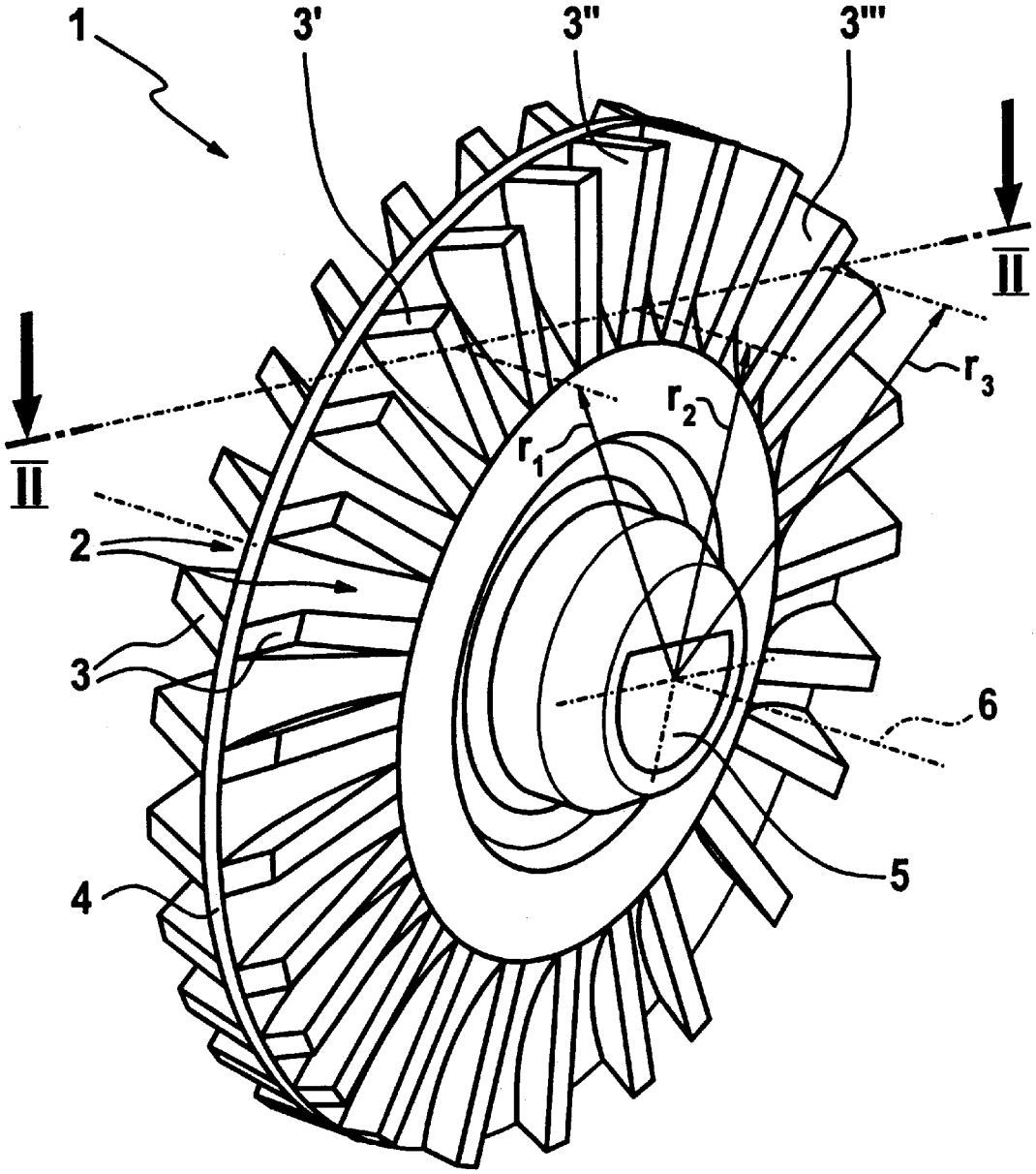
FIG. 1 shows an isometric illustration of an impeller of a peripheral pump.

The impeller 1 illustrated in FIG. 1 is a peripheral wheel of a fuel pump. Blade chambers 2 are arranged, distributed over the circumference, in the outer region of the impeller 1 on both sides. The individual blade chambers 2 are delimited by moving blades 3. Blade chambers 2 located opposite one another are separated from one another by a web 4. A recess 5 serves for receiving a shaft, not illustrated, of an electric motor for driving the impeller 1. The radii $r_1$, $r_2$, $r_3$ indicate the distance of the moving blades 3', 3", 3'" from the axis of rotation 6 of the impeller 1 as far as the section II—II.

Figure 2:
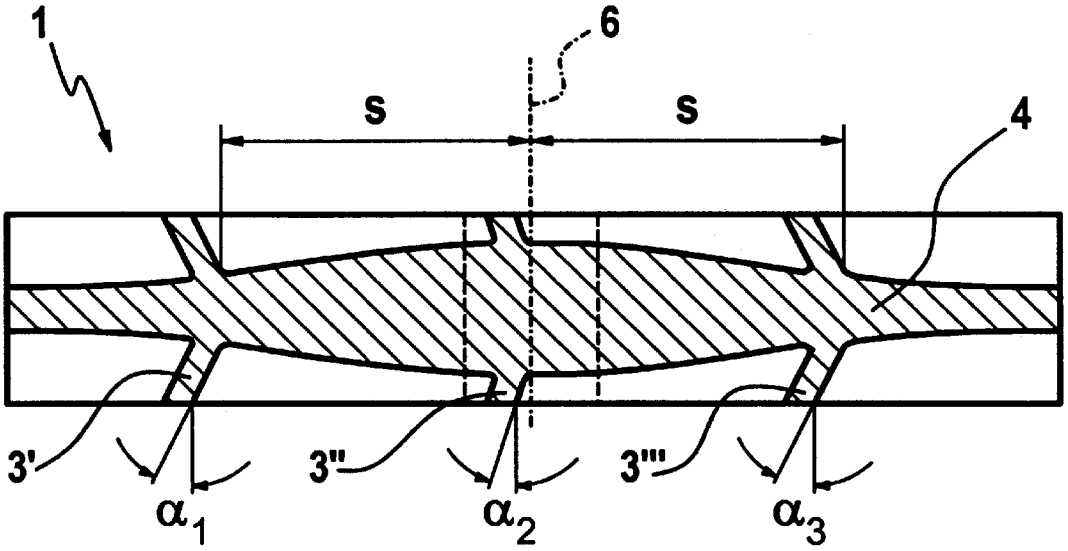
FIG. 2 shows a section along the line II—II of the impeller from FIG. 1.

FIG. 2 shows a diagrammatic top view of the impeller 1 from FIG. 1 along a section II—II, only the moving blades 3', 3", 3'" being illustrated in this view. The section is taken through the moving blades 3', 3", 3'" at a distance $r_1$, $r_2$, $r_3$ from the axis of rotation 6. The distances $r_1$, and $r_3$ are identical, so that the moving blades 3', 3'" are at the same distance s from the axis of rotation 6 in a sectional plane. The moving blades 3', 3", 3'" are arranged in a V-shaped manner in relation to the moving blades located opposite them on the other side of the impeller 1. The angle of the moving blades 3', 3", 3'" relative to the axis of rotation 6 behaves according to the relation.

$$\alpha(r) = \arctan\left(\frac{r \cdot \tan(\alpha[r_a])}{r_a}\right).$$

Accordingly, the moving blade 3' has, at the point of the radius $r_1$, an angle $\alpha_1$ which, by virtue of symmetry with the moving blade 3'" is equal to the angle $\alpha_3$. The moving blade 3" has the angle $\alpha_2$ at the point $r_2$. The angle $\alpha_2$ is smaller than the two angles $\alpha_1$ and $\alpha_3$.

Figure 3:
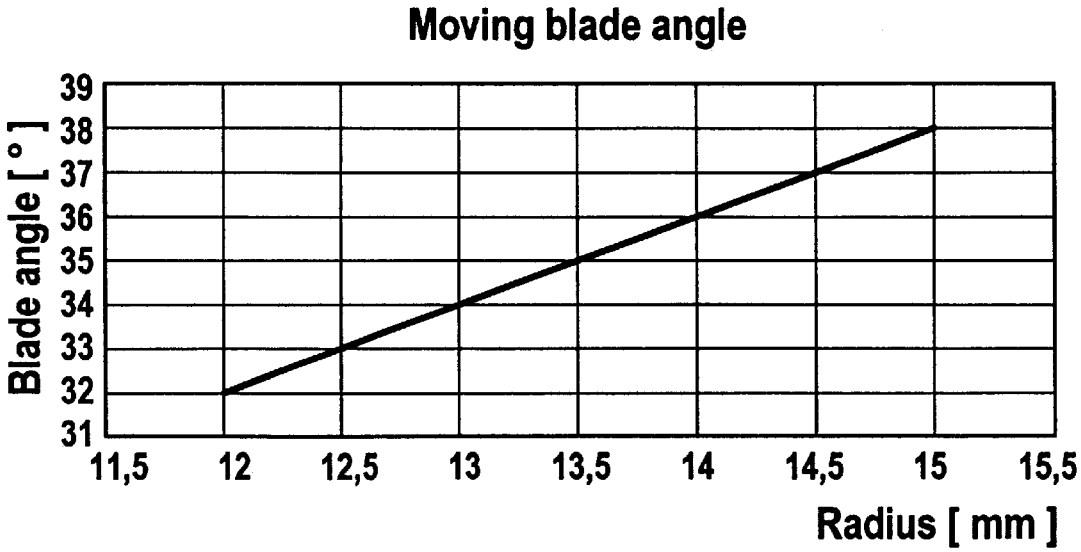
FIG. 3 shows the angle change of a moving blade against the height of the blade chamber.

FIG. 3 illustrates the angle profile a of a moving blade 3. The radius r is plotted on the abscissa against the radial extent of the blade chamber 2. The radially inner edge of the moving blade 3 commences at a radius of 12 mm, whilst the outer edge of the moving blade 3 extends to 15 mm. At an angle $\alpha(r_a)$=38°, predetermined at the point $r_a$ of 15 mm, a curve is obtained for the angle profile of the moving blade 3. The moving blade 3 has an angle of 32° at its radially inner edge.

What is claimed is:

1. A feed pump having a driven impeller for rotation in a pump casing, comprising:

at least one ring of blade chambers which is arranged on one end face of the impeller, said blade chambers delimited laterally by blades arranged at an angle $\alpha$ to the axis of rotation of the impeller, wherein the blades (3) are arranged, over the height of the blade chambers (2), at an angle $\alpha(r)$ corresponding to the formula $$\alpha(r) = \arctan\left(\frac{r \cdot \tan(\alpha(r_a)}{r_a}\right),$$

r being any distance between the center point of the impeller (1) and a point on the blade (3), $r_a$ being the distance between the center point of the impeller (1) and a predetermined point on the blade and $\alpha(r_a)$ being a predetermined angle; and a feed channel located opposite the ring of blade chambers and arranged in the wall of the pump casing.

2. The feed pump as claimed in claim 1, wherein the distance $r_a$ is the radius from the center point of the impeller (1) to the radially inner edge, the center or the radially outer edge of the blade (3).

3. The feed pump as claimed in claim 1, wherein the angle $\alpha(r_a)$ at the radially outer edge of the blade (3) is between 30° and 40°.

4. The feed pump as claimed in claim 1, wherein the blades (3) of the impeller (1) are oriented in the direction of rotation.

5. The feed pump as claimed in claim 1, wherein the impeller (1) has two rings of blade chambers (2), the blades (3) of which are oriented in a V-shaped manner in relation to one another, said rings being located opposite one another on the end faces.

* * * * *